US011247864B1

(12) United States Patent
Martelli

(10) Patent No.: US 11,247,864 B1
(45) Date of Patent: Feb. 15, 2022

(54) FABRIC TENSION CONTROL APPARATUS AND METHOD

(71) Applicant: John D. Martelli, Pensacola, FL (US)

(72) Inventor: John D. Martelli, Pensacola, FL (US)

( * ) Notice: Subject to any disclaimer, the term of this patent is extended or adjusted under 35 U.S.C. 154(b) by 181 days.

(21) Appl. No.: 16/593,120

(22) Filed: Oct. 4, 2019

Related U.S. Application Data

(60) Provisional application No. 62/741,013, filed on Oct. 4, 2018.

(51) Int. Cl.
*B65H 18/10* (2006.01)
*B65H 23/18* (2006.01)

(52) U.S. Cl.
CPC ..... *B65H 23/1806* (2013.01); *B65H 18/103* (2013.01)

(58) Field of Classification Search
CPC ..... B65H 23/1806; B65H 18/103
See application file for complete search history.

(56) References Cited

U.S. PATENT DOCUMENTS 4,958,111 A * 9/1990 Gago ..... B65H 23/038 226/24
9,403,653 B2 * 8/2016 Matsumura ..... B65H 23/1806
10,017,345 B2 * 7/2018 Franke ..... B65H 18/103
10,112,736 B2 * 10/2018 Kanno ..... B65H 26/025
10,337,131 B2 * 7/2019 Konzak ..... D05B 11/00
2015/0375536 A1 * 12/2015 Matsumura ..... B65H 23/1806 347/16
2017/0107070 A1 * 4/2017 Franke ..... B65H 20/02
2017/0217623 A1 * 8/2017 Kanno ..... B65H 26/025

* cited by examiner

*Primary Examiner* — Sang K Kim
(74) *Attorney, Agent, or Firm* — J. Nevin Shaffer, Jr.

(57) ABSTRACT

An improved fabric tension control apparatus and method consisting of a fabric handler with a feed roller, an idler roller and a take up roller and where fabric on the feed roller is transferred from the feed roller past the idler roller to the take up roller. A feed roller motor is connected with the feed roller and a take up roller motor is connected with the take up roller. A motion sensor tracks speed of rotation of the idler roller. A feed roller driver is connected with the feed roller motor and a take up roller driver is connected with the take up roller motor. A controller is connected with the feed roller driver, the take up roller driver and the motion sensor where the controller receives the speed of rotation of the idler roller from the motion sensor and where the controller sends speed adjustment instructions to the take up roller driver and the feed roller driver and where the speed adjustment instructions are sent to the feed roller motor and the take up roller motor such that the speed of the take up roller and the feed roller are adjusted such that the speed of the idler roller is constant so as to maintain a desired tension on the fabric as it is transferred.

20 Claims, 2 Drawing Sheets

FABRIC TENSION CONTROL APPARATUS AND METHOD

CROSS REFERENCE TO RELATED APPLICATION

This application claims the benefit of previously filed U.S. provisional patent application No. 62/741,013 filed Oct. 4, 2018 for a "Fabric Tension Control Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to an improved fabric tension control apparatus and method consisting of a fabric handler with a feed roller, an idler roller and a take up roller. Fabric on the feed roller is transferred from the feed roller past the idler roller to the take up roller. A feed roller motor is connected with the feed roller and a take up roller motor is connected with the take up roller. A motion sensor tracks speed of rotation of the idler roller. A feed roller driver is connected with the feed roller motor and a take up roller driver is connected with the take up roller motor. A controller is connected with the feed roller driver, the take up roller driver and the motion sensor where the controller receives the speed of rotation of the idler roller from the motion sensor and where the controller sends speed adjustment instructions to the take up roller driver and the feed roller driver and where the speed adjustment instructions are sent to the feed roller motor and the take up roller motor such that the speed of the take up roller and the feed roller are adjusted such that the speed of the idler roller is constant so as to maintain a desired tension on the fabric as it is transferred.

BACKGROUND OF THE INVENTION

There are many occasions in which it is necessary to maintain proper tension on material as it is transferred from one place to another. By way of example only and not by limitation, the creation of quilts requires the fabric to be tensioned sufficiently during creation of a quilt and the application of thread designs and such. If the fabric is too loose or too tight the resulting quilt and/or design or image is invariably unacceptable. The prior art solution requires constant monitoring and manual adjustment of various clutches and other devices to allow the elements of a quilting machine to add or remove tension to the fabric. An added complication is that as a mass of fabric is transferred from one location to another, the reduction of mass in one place and the addition of fabric build up in another constantly alters the speed of transfer and the tension between the two.

Thus, there is a need in the art for a mechanism and method that addresses the aforementioned problems in a manner that is robust and flexible so as to accommodate a full spectrum of material manipulation machines, materials and dimensions.

It therefore is an object of this invention to provide an improved fabric tension controller apparatus and method for enabling the precise control and adjustment of fabric tension in a fabric handling machine that is easy to use and economical to install and operate.

SUMMARY

Accordingly, an improved fabric tension control apparatus and method consists of a fabric handler with a feed roller, an idler roller and a take up roller and where fabric on the feed roller is transferred from the feed roller past the idler roller to the take up roller. A feed roller motor is connected with the feed roller and a take up roller motor is connected with the take up roller. A motion sensor tracks speed of rotation of the idler roller. A feed roller driver is connected with the feed roller motor and a take up roller driver is connected with the take up roller motor. A controller is connected with the feed roller driver, the take up roller driver and the motion sensor where the controller receives the speed of rotation information of the idler roller from the motion sensor and where the controller sends speed adjustment instructions to the take up roller driver and the feed roller driver and where the speed adjustment instructions are sent to the feed roller motor and the take up roller motor such that the speed of the take up roller and the feed roller are adjusted such that the speed of the idler roller is constant so as to maintain a desired tension on the fabric as it is transferred.

In one aspect, the apparatus further includes a second feed roller where the feed roller motor is connected to both the feed roller and the second feed roller and two separate fabrics are provided where one fabric is located on the feed roller and another fabric is located on the second feed roller.

In another aspect, the apparatus further includes a feed roller motor shaft with a first end connected with the feed roller motor and a second end connected with a feed roller motor timing gear. A sprocket is connected with the feed roller and the second feed roller and a first pulley connected with both the feed roller motor timing gear and the feed roller sprocket and a second pulley connected with both the feed roller motor timing gear and the second feed roller sprocket.

In one aspect, a take up roller motor shaft with a first end is connected with the take up roller motor and a second end is connected with a take up roller motor timing gear. A sprocket is connected with the take up roller and a first pulley is connected with the take up roller motor timing gear and the take up roller sprocket.

In a further aspect, the motion sensor is an optic reader and in one aspect, a gear with optic scanner readable marks is attached to the idler roller where the optic reader determines the speed of rotation of the idler roller from movement of the gear.

In one aspect, the fabric is selected from a group of materials consisting of: cloth, plastic, paper and metal.

In one aspect, as fabric is transferred from the feed roller to the take up roller, the controller slows down the speed of the feed roller and speeds up the speed of the take up roller such that the speed of the idler roller is constant In one aspect, the apparatus further includes a wireless transmitter configured to connect with the controller for operation of the controller.

According to another embodiment, a fabric tension control apparatus consists of a fabric handler where the fabric handler includes a first feed roller, a second feed roller, an idler roller with timing marks, a take up roller, and two separate fabrics where one fabric on the first feed roller and another fabric on the second feed roller are transferred from both the first feed roller and the second feed roller past said idler roller to the take up roller. A feed roller motor is connected with the first feed roller and the second feed roller. A take up roller motor is connected with the take up roller. A motion sensor is provided where the motion sensor tracks movement of the timing marks on the idler roller. A feed roller driver is connected with the feed roller motor and a take up roller driver connected with the take up roller motor. A controller is connected with the feed roller driver, the take up roller driver and the motion sensor where the controller determines the speed of rotation of the idler roller from the motion sensor and where the controller sends speed adjustment instructions to the take up roller driver and the feed roller driver and where the speed adjustment instructions are sent to the feed roller motor and the take up roller motor such that the speed of the take up roller and the feed rollers is adjusted such that the speed of the idler roller is constant so as to maintain a desired tension on both of the two fabrics.

In one aspect, the apparatus includes a feed roller motor shaft with a first end connected with the feed roller motor and a second end connected with a feed roller motor timing gear. A sprocket is connected with the first feed roller and the second feed roller and a first pulley is connected with both the feed roller motor timing gear and the feed roller sprocket and a second pulley is connected with both the feed roller motor timing gear and the second feed roller sprocket.

In another aspect, a take up roller motor shaft is provided with a first end connected with the take up roller motor and a second end connected with a take up roller motor timing gear. A sprocket is connected with the take up roller and a first pulley is connected with the take up roller motor timing gear and the take up roller sprocket.

In one aspect, the motion sensor is an optic scanner. In another aspect, a gear with optic scanner readable marks is attached to the idler roller and where the optic reader determines speed of rotation of the idler roller from movement of the gear.

In one aspect, the fabric is selected from a group of materials consisting of: cloth, plastic, paper and metal.

In another aspect, as fabric is transferred from the feed roller to the take up roller, the controller slows down the speed of the feed roller and speeds up the speed of the take up roller such that the speed of the idler roller is constant In one aspect, the apparatus further includes a wireless transmitter configured to connect with the controller for operation of the controller.

According to another embodiment, a fabric tension control method consists of:

a. providing a fabric handler where the fabric handler includes a feed roller, an idler roller and a take up roller and where fabric on the feed roller is transferred from the feed roller past the idler roller to the take up roller; a feed roller motor connected with the feed roller, a take up roller motor connected with the take up roller; a motion sensor where the motion sensor tracks speed of rotation of the idler roller; a feed roller driver connected with the feed roller motor; a take up roller driver connected with the take up roller motor; and a controller connected with the feed roller driver, the take up roller driver and the motion sensor where the controller receives the speed of rotation of the idler roller from the motion sensor and where the controller sends speed adjustment instructions to the take up roller driver and the feed roller driver; and b. where the speed adjustment instructions are sent to the feed roller motor and the take up roller motor such that the speed of the take up roller and the feed roller is adjusted such that the speed of the idler roller is constant so as to maintain a desired tension on the fabric as it is transferred.

In one aspect, the method further includes a second feed roller where the feed roller motor is connected to both the feed roller and the second feed roller and two separate fabrics where one fabric is located on the feed roller and another fabric is located on the second feed roller.

In a further aspect, the fabric handler is a MARTELLI brand quilting machine.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
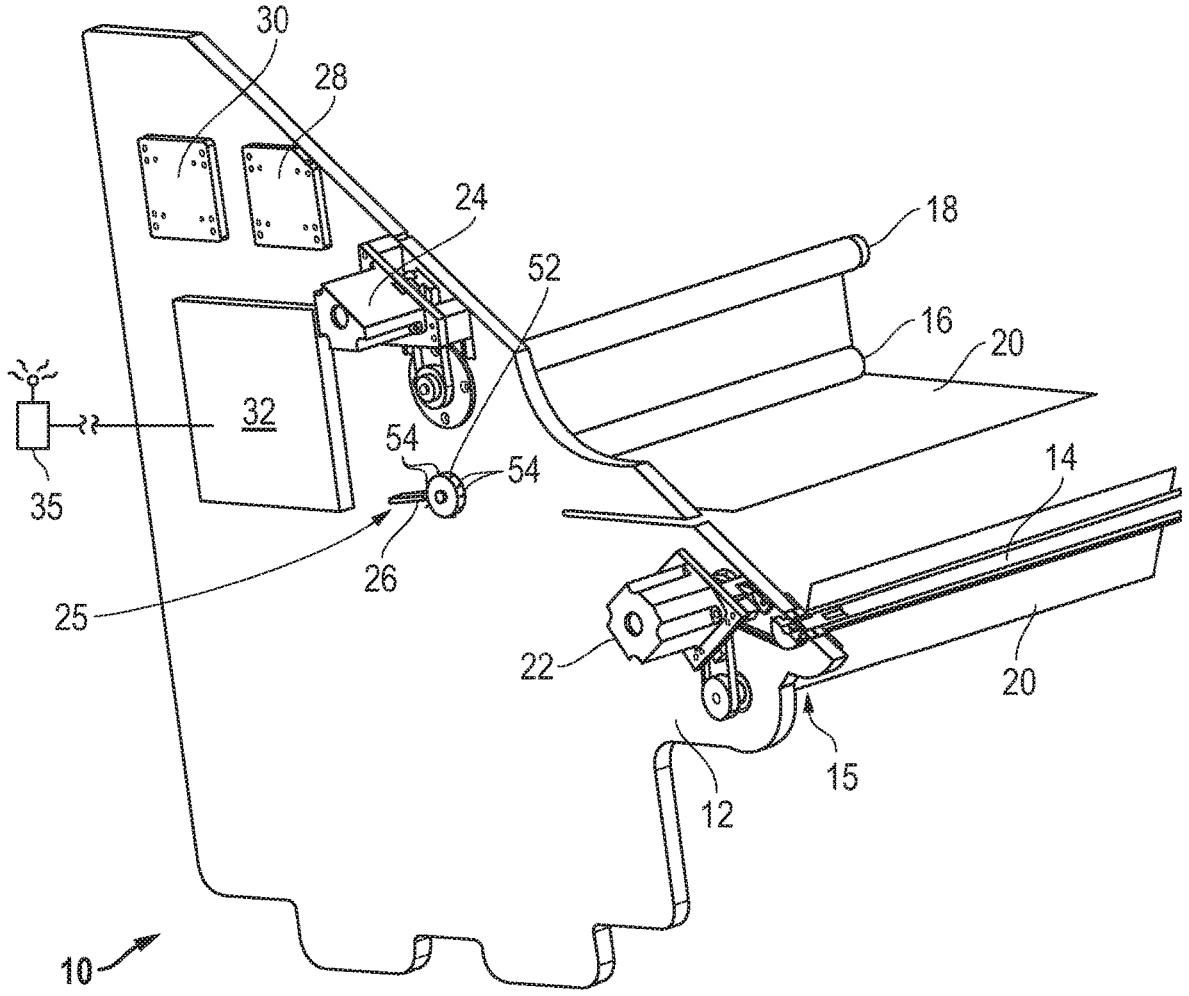
FIG. 1 is a perspective partial cut away view of the improved fabric tension control apparatus from the left side.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process and/or algorithms are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

Figure 2:
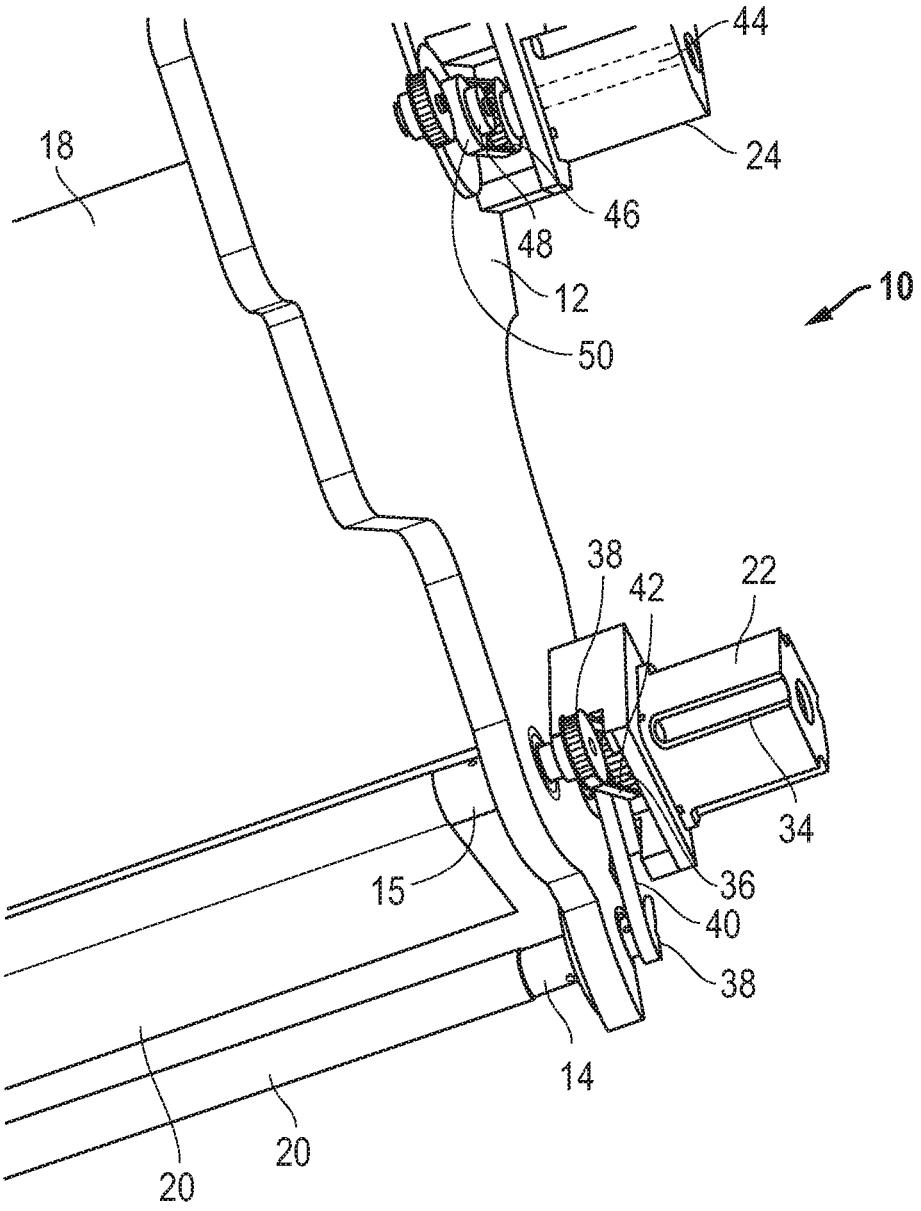
FIG. 2 is a perspective view of the invention of FIG. 1 from the right side and including pulleys, timing gear and sprockets.

One embodiment of the present invention is illustrated by way of example in FIGS. 1 and 2.

With reference to FIG. 1, fabric tension control apparatus 10 includes a fabric handler 12. All terms used herein are given their common meaning. Thus by "fabric handler", Applicant refers to any machine for manipulating fabric where the fabric is under tension and the tension of the "fabric" is an important factor. The partial figure presented in the drawings is typical of quilting machines and is used as a representative model for understanding the functional elements of the invention. In one embodiment, the fabric handler is a MARTELLI brand quilting machine.

Also, "fabric" is used in its broadest sense and includes quilting material, sheets of cloth, and even paper and plastic and metal and other materials as it is known that there are needs for maintenance of tension in those materials during processing as well.

The fabric handler 12, in one embodiment, includes a feed roller 14, an idler roller 16 and a take up roller 18. In operation, fabric 20 loaded on the feed roller 14 is transferred from the feed roller 14 past the idler roller 16 to the take up roller 18. A feed roller motor 22 is connected with the feed roller 14 and a take up roller motor 24 is connected with the take up roller 18. A motion sensor 25, preferably an optic reader 26, located near or connected with the idler roller 16, tracks speed of rotation of the idler roller 16. By "tracks", it is understood that motion sensor 25, optic reader 26, observes, records and otherwise captures and obtains the motion and speed of rotation of the idler roller 16 and sends it to a controller 32 as described more fully hereafter. It may be that the motion sensor 25 calculates and sends the actual speed of rotation or that the controller 32 calculates the speed of rotation from the information sent it by the motion sensor 25.

A feed roller driver 28 is connected with the feed roller motor 22 and a take up roller driver 30 is connected with the take up roller motor 24. The term "driver" describes a mechanism, such as an electrical mechanical computer system, for controlling the operation of another device. A controller 32 is connected with the feed roller driver 28, the take up roller driver 30 and the motion sensor 25/optic reader 26 where the controller 32 receives the speed of rotation of the idler roller 16 from the motion sensor 25/optic reader 26 and where the controller 32 sends speed adjustment instructions to the take up roller driver 30 and the feed roller driver 28. The speed adjustment instructions are sent by the feed roller driver 28 to the feed roller motor 22 and by the take up roller driver 30 to the take up roller motor 24 such that the speed of the take up roller 18 and the feed roller 14 are adjusted so as to maintain a desired tension on the fabric 20 as it is transferred. Here the controller 32 is understood to receive input data, rotational speed, and to compare it to a user selected idler roller 16 rotational speed and to calculate the required combined feed roller 14 speed and take up roller 18 speed needed to maintain the selected idler roller 14 speed and thus the desired tension on the fabric 20.

Again, terms used herein are given their common meaning as known in the art as with the terms"motion sensor", "optic reader", "driver", and "controller", for example only. Again, "controller" describes an electrical mechanical device for receiving input and sending control signals to connected mechanisms. A computer system, for example, that receives input, manipulates the input and, according to its programing instructions, calculates output instructions and sends them to connected devices. The connection may be physical or wireless or both. The controller 32 may be operated by manual manipulation or by means of a wireless transmitter 33. Wireless transmitter 33 may be a dedicated device or a cell phone, Ipad, laptop or some other mechanism as are now known or hereafter developed. Likewise, terms known in the art, such as quilting, for example only, includes terms such as "take up roller" and "feed roller" and "idler roller" that are known to those of ordinary skill in the art and are not described more fully hereafter.

Referring now to FIGS. 2 and 1. FIG. 2 illustrates that the operational elements of the invention may be located on either side of fabric handler 12. Further, other elements of the invention are shown more clearly in FIG. 2. In this regard, in one aspect, the fabric tension control apparatus 10 further includes a second feed roller 15 where the feed roller motor 22 is connected to both the feed roller 14 and the second feed roller 15 and where fabric 20 is located on both the feed roller 14 and the second feed roller 15. Quilts, for example only, are often made by joining two separate lengths of fabric, often with material sandwiched in-between, with stitching while the two fabrics are under tension.

In another aspect, the fabric tension control apparatus 10 further includes a feed roller motor shaft 34 with a first end connected with the feed roller motor 22 and a second end connected with a feed roller motor timing gear 36. A sprocket 38 is connected with the feed roller 14 and, when present, the second feed roller 15. A first pulley 40 is connected with both the feed roller motor timing gear 36 and the feed roller sprocket 38 and a second pulley 42 is connected with both the feed roller motor timing gear 36 and the second feed roller 15 sprocket 38. By this structure, the movement of both the feed roller 14 and the second feed roller 15 is connected such that both move together at the same desired rotational speed.

In a further aspect, the fabric tension control apparatus 10 includes a take up roller motor shaft 44 with a first end connected with the take up roller motor 24 and a second end connected with a take up roller motor timing gear 46, a sprocket 48 is connected with the take up roller 18 and a first pulley 50 connected with the take up roller motor 24 timing gear 46 and the take up roller 18 sprocket 48. By this structure, the movement of the take up roller 18 is controlled and manipulated such that the desired take up speed is accurately delivered and maintained.

In one aspect, a gear 52 with optic scanner readable marks 54 is attached to the idler roller 16 and the optic reader 26 determines speed of rotation of the idler roller 16 from movement of the gear 52. "Optic scanner readable marks" describes marks applied to the idler roller 16 in a manner such that movement of the idler roller 16 past the optic reader 26 is observable by the optic reader 26 and, by measurement of the time between marks, a speed of rotation is obtained, for example only. Again the calculation of the speed of rotation may be made by the controller 32 from analysis of the raw motion input data received from the motion sensor 25/optic reader 26. Other structures are included within the scope of the invention such that any motion sensor 25 device for detecting/computing the speed of rotation is included herein.

The problem of tension in a moving material is one that has vexed industries in a wide variety of fields. By way of example only, and not by limitation, Applicant has developed the present invention to use a heretofore "irrelevant" feature in the "quilting" world, the rotation of the idler roller 16, as the key to ensuring a constantly accurate and correctable tension in a fabric 20. The desired tension may be altered as needed simply by adjusting the controller 32, either directly at the controller 32 or remotely by means of a wireless transmitter 33, without need to adjust any other structural feature of the apparatus. This results in a huge savings in time and money and makes a problem previously requiring a specialist a solution for even the newest users of a complicated machine. The MARTELLI brand quilting machine is representative of a preferred quilting machine.

Additionally, a fabric tension control method consists in one embodiment of providing a fabric handler 12 where the fabric handler 12 includes a feed roller 14, an idler roller 16 and a take up roller 18; fabric 20 on the feed roller 14 is transferred from the feed roller 14 past the idler roller 16 to the take up roller 18; a feed roller motor 22 connected with the feed roller 14; a take up roller motor 24 connected with the take up roller 18; a motion sensor 25 tracks speed of rotation of the idler roller 16; a feed roller driver 28 connected with the feed roller motor 22; a take up roller driver 30 connected with the take up roller motor 24; and a controller 32 connected with the feed roller driver 28, the take up roller driver 30 and the motion sensor 25 where the controller 32 receives the speed of rotation of the idler roller 16 from the motion sensor 25 and where the controller 32 sends speed adjustment instructions to the take up roller driver 30 and the feed roller driver 28; and b. where the speed adjustment instructions are sent to the feed roller motor 22 and the take up roller motor 24 such that the speed of the take up roller 18 and the feed roller 16 is adjusted such that the speed of the idler roller 16 is constant (at the selected rotational speed) so as to maintain a desired tension on the fabric 20 as it is transferred.

As should be understood, the "tension" in the fabric 20 is a constantly changing variable which for decades has imposed a tedious duty on quilters, for example only. Constant observation was required to determine when it was necessary to adjust the quilting machine to a desired tension. By way of the present invention, fabric 20 on the feed roller 14 is fed past the idler roller 16 to the take up roller 18 and the fabric handler 12 is operated. A user then adjusts the speed of the feed roller 14 and/or the take up roller 18 such that the fabric is under a desired tension. At that point, the motion sensor 25 sends the speed of rotation of the idler roller 16 (or the controller 32 calculates the speed of rotation from the detected motion) to the controller 32 and that speed is set at the controller 32. Thereafter, as continued operation of the fabric handler 12 moves fabric 20 from feed roller 14 to take up roller 18 and feed roller 14 tends to speed up and take up roller 18 tends to slow down, the motion sensor 25 detects/observes the speed of rotation of the idler roller 16. Controller 32 constantly compares the desired set speed of the idler roller 16 and when it changes it then sends signals to the take up roller driver 30/take up roller motor 24 and/or to the feed roller driver 28/feed roller motor 22 to speed up the take up roller 18 and/or slow down the feed roller 14 or a combination of both so as to maintain the set/selected speed of rotation of the idler roller 16 and thus the desired tension in fabric 20.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A fabric tension control apparatus comprising:

a. a fabric handler wherein said fabric handler includes a feed roller, an idler roller and a take up roller, and wherein fabric on said feed roller is transferred from said feed roller past said idler roller to said take up roller;

b. a feed roller motor connected with said feed roller;

c. a take up roller motor connected with said take up roller;

d. a motion sensor wherein said motion sensor tracks speed of rotation of said idler roller;

e. a feed roller driver connected with said feed roller motor;

f. a take up roller driver connected with said take up roller motor, and g. a controller connected with said feed roller driver, said take up roller driver and said motion sensor, wherein said controller receives the speed of rotation of the idler roller from said motion sensor, and wherein said controller sends speed adjustment instructions to said take up roller driver and said feed roller driver, and wherein said speed adjustment instructions are sent to said feed roller motor and said take up roller motor such that the speed of said take up roller and said feed roller is adjusted such that the speed of the idler roller is constant.

2. The apparatus of claim 1 further including a second feed roller wherein said feed roller motor is connected to both the feed roller and the second feed roller and two separate fabrics wherein one fabric is located on the feed roller and another fabric is located on the second feed roller.

3. The apparatus of claim 2 further comprising:

a. a feed roller motor shaft with a first end connected with the feed roller motor and a second end connected with a feed roller motor timing gear;

b. a sprocket connected with the feed roller and the second feed roller; and c. a first pulley connected with both the feed roller motor timing gear and the feed roller sprocket and a second pulley connected with both the feed roller motor timing gear and the second feed roller sprocket.

4. The apparatus of claim 1 further comprising:

a. a take up roller motor shaft with a first end connected with the take up roller motor and a second end connected with a take up roller motor timing gear;

b. a sprocket connected with the take up roller; and c. a first pulley connected with the take up roller motor timing gear and the take up roller sprocket.

5. The apparatus of claim 1 wherein the motion sensor is an optic reader.

6. The apparatus of claim 5 wherein a gear with optic scanner readable marks is attached to said idler roller and wherein said optic reader determines speed of rotation of said idler roller from movement of said gear.

7. The apparatus of claim 1 wherein the fabric is selected from a group of materials consisting of: cloth, plastic, paper and metal.

8. The apparatus of claim 1 wherein as fabric is transferred from said feed roller to said take up roller, the controller slows down the speed of the feed roller and speeds up the speed of the take up roller such that the speed of the idler roller is constant.

9. The apparatus of claim 1 further including a wireless transmitter configured to connect with the controller for operation of the controller.

10. The apparatus of claim 1 further including a wireless transmitter configured to connect with the controller for operation of the controller.

11. A fabric tension control apparatus comprising:

a. a fabric handler, wherein said fabric handler includes a first feed roller, a second feed roller, an idler roller with timing marks, a take up roller, and two separate fabrics, wherein one fabric on said first feed roller and another fabric on said second feed roller are transferred from both the first feed roller and the second feed roller past said idler roller to said take up roller, b. a feed roller motor connected with said first feed roller and said second feed roller;

c. a take up roller motor connected with said take up roller;

d. a motion sensor, wherein said motion sensor tracks movement of the timing marks on said idler roller;

e. a feed roller driver connected with said feed roller motor;

f. a take up roller driver connected with said take up roller motor; and g. a controller connected with said feed roller driver, said take up roller driver and said motion sensor, and wherein said controller determines the speed of rotation of the idler roller from the motion sensor, and wherein said controller sends speed adjustment instructions to said take up roller driver and said feed roller driver, and wherein said speed adjustment instructions are sent to said feed roller motor and said take up roller motor such that the speed of said take up roller and said feed rollers is adjusted such that the speed of the idler roller is constant so as to maintain a desired tension on both said fabrics.

12. The apparatus of claim 11 further comprising:

a. a feed roller motor shaft with a first end connected with the feed roller motor and a second end connected with a feed roller motor timing gear;

b. a sprocket connected with the first feed roller and the second feed roller; and c. a first pulley connected with both the feed roller motor timing gear and the feed roller sprocket and a second pulley connected with both the feed roller motor timing gear and the second feed roller sprocket.

13. The apparatus of claim 11 further comprising:

a. a take up roller motor shaft with a first end connected with the take up roller motor and a second end connected with a take up roller motor timing gear, b. a sprocket connected with the take up roller; and c. a first pulley connected with the take up roller motor timing gear and the take up roller sprocket.

14. The apparatus of claim 11 wherein the motion sensor is an optic scanner.

15. The apparatus of claim 14 wherein a gear with optic scanner readable marks is attached to said idler roller and wherein said optic reader determines speed of rotation of said idler roller from movement of said gear.

16. The apparatus of claim 11 wherein the fabric is selected from a group of materials consisting of: cloth, plastic, paper and metal.

17. The apparatus of claim 11 wherein as fabric is transferred from said feed roller to said take up roller, the controller slows down the speed of the feed roller and speeds up the speed of the take up roller such that the speed of the idler roller is constant.

18. A fabric tension control method comprising:

a. providing a fabric handler wherein said fabric handler includes a feed roller, an idler roller and a take up roller, and wherein fabric on said feed roller is transferred from the feed roller past said idler roller to said take up roller; a feed roller motor connected with said feed roller, a take up roller motor connected with said take up roller; a motion sensor, wherein said motion sensor tracks speed of rotation of said idler roller; a feed roller driver connected with said feed roller motor; a take up roller driver connected with said take up roller motor; and a controller connected with said feed roller driver, said take up roller driver and said motion sensor, wherein said controller receives the speed of rotation of the idler roller from said motion sensor, and wherein said controller sends speed adjustment instructions to said take up roller driver and said feed roller driver; and b. wherein said speed adjustment instructions are sent to said feed roller motor and said take up roller motor such that the speed of said take up roller and said feed roller is adjusted such that the speed of the idler roller is constant so as to maintain a desired tension on said fabric as it is transferred.

19. The method of claim 18 further including a second feed roller wherein said feed roller motor is connected to both the feed roller and the second feed roller and two separate fabrics wherein one fabric is located on the feed roller and another fabric is located on the second feed roller.

20. The method of claim 18 wherein the motion sensor is an optic reader and wherein a gear with optic scanner readable marks is attached to said idler roller and wherein said optic reader determines speed of rotation of said idler roller from movement of said gear.

* * * * *